US012566005B2

(12) United States Patent
Pettersen

(10) Patent No.: US 12,566,005 B2
(45) Date of Patent: Mar. 3, 2026

(54) PRESENCE DETECTION

(71) Applicant: Airthings ASA, Oslo (NO)

(72) Inventor: Mattis Pettersen, Oslo (NO)

(73) Assignee: Airthings ASA, Oslo (NO)

( * ) Notice: Subject to any disclaimer, the term of this patent is extended or adjusted under 35 U.S.C. 154(b) by 371 days.

(21) Appl. No.: 18/205,462

(22) Filed: Jun. 2, 2023

(65) Prior Publication Data

US 2023/0392807 A1 Dec. 7, 2023

(30) Foreign Application Priority Data

Jun. 7, 2022 (GB) ..... 2208312

(51) Int. Cl.

| | |
|---|---|
| ***F24F 11/00*** | (2018.01) |
| *F24F 110/20* | (2018.01) |
| *F24F 110/66* | (2018.01) |
| *F24F 110/70* | (2018.01) |
| *F24F 120/12* | (2018.01) |

(52) U.S. Cl.

CPC ..... *F24F 11/0001* (2013.01); *F24F 2110/20* (2018.01); *F24F 2110/66* (2018.01); *F24F 2110/70* (2018.01); *F24F 2120/12* (2018.01)

(58) Field of Classification Search

CPC ..... F24F 11/0001

See application file for complete search history.

(56) References Cited

U.S. PATENT DOCUMENTS

2018/0299153 A1* 10/2018 Ajax ..... G05B 13/021
2022/0049870 A1* 2/2022 Chatwin ..... F24F 11/00

FOREIGN PATENT DOCUMENTS

| | | | | | |
|---|---|---|---|---|---|
| CN | 110207324 | B | | 9/2020 | |
| JP | S59204767 | | | 5/1983 | |
| JP | S59204767 | A | | 11/1984 | |
| JP | 2004278868 | | | 3/2003 | |
| JP | 2004278868 | A | | 10/2004 | |
| JP | 2011133164 | A | * | 7/2011 | |
| KR | 20220072803 | A | * | 6/2022 | ..... F24F 11/63 |

OTHER PUBLICATIONS

IPO Search Report under Section 17(5) for GB2208312.5, mailed Nov. 16, 2022, 4 pages.

European Search Report cited in corresponding application 23176524.9, dated Oct. 23, 2023, 8 pages.

* cited by examiner

*Primary Examiner* — Mark A Connolly

(74) *Attorney, Agent, or Firm* — Klarquist Sparkman, LLP

(57) ABSTRACT

A method of estimating occupancy of a room, comprising: acquiring a plurality of measurements of an aspect of air quality in the room; and estimating the occupancy of the room based on the plurality of measurements and a room ventilation rate parameter. By estimating the occupancy of the room based on aspects of air quality, it is possible to detect occupancy based on data from sensors which may already be present for other purposes (e.g. for measuring air quality). Combining measurements of air quality with knowledge related to ventilation rate results in information indicative of the occupancy. Estimating the number of people in the room allows detailed analysis and control to be undertaken. Such occupancy data can also be used to control other services, e.g. to control the ventilation or to provide information about the number of people present.

24 Claims, 12 Drawing Sheets

PRESENCE DETECTION

The present invention relates to presence detection and/or occupancy detection indoors.

It can be useful to sense the presence of one or more people within an area (or within several areas) of a building. For example, it can be useful to gather information on the locations of people for security or emergency purposes. As another example, it can be useful to gather information on the usage of different spaces within a building. For example, if certain spaces are overused and other spaces are underused then it may be possible to change layouts and/or practices to improve efficiency and/or comfort.

Various presence detection systems are known which can detect the presence of people within certain areas. For example infrared sensors, radar sensors, motion sensors, acoustic sensors, ultrasound sensors, vibration sensors and cameras can all be used to detect the presence or absence of people and/or objects in an area. At a simple level a sensor may be used to detect a change in the environment (e.g. a simple automatic light sensor which activates a light when a person enters a detection area), or complex data processing may be used to count the number of persons or objects present and/or to identify the persons and/or objects (e.g. using image recognition such as facial recognition) or to detect certain characteristics of persons or objects (e.g. for security and tracking systems).

According to one aspect of the invention there is provided a method of estimating occupancy of a room, comprising:

- acquiring a plurality of measurements of an aspect of air quality in the room; and
- estimating the occupancy of the room based on the plurality of measurements and a room ventilation rate parameter.

By estimating the occupancy of the room based on aspects of air quality, it is possible to detect occupancy based on data from sensors which may already be present for other purposes (e.g. for measuring and monitoring the air quality within the room). It has been recognised that combining measurements of air quality with knowledge related to ventilation rate in the room results in information indicative of (or dependent upon) the occupancy of the room.

Determining or estimating occupancy of the room may be a simple binary detection, e.g. present or not present. However, it is more useful to be able to determine the number of people, i.e. the degree of occupancy of the room. The plurality of measurements of air quality combined with information on ventilation rate can provide this level of information and therefore in some examples, estimating the occupancy comprises estimating a number of people in the room. Estimating the number of people in the room allows much more detailed analysis and control to be undertaken, e.g. it can be used to analyse which parts of a building (or floor) are most used and which are least used. Such occupancy data can also be used to control other services, e.g. to control the ventilation or to provide information about the number of people present (e.g. for catering or for security or safety analysis).

Many different aspects of air quality can be used. However, in some examples the aspect of air quality is an aspect that changes dependent on the presence of people. For example the aspect of air quality may be an aspect that depends upon substances emitted by people or by their clothing. In some examples the aspect of air quality is one or more of: $CO_2$ concentration, VOC concentration and humidity level. $CO_2$ is emitted by people when they breathe. Humidity is influenced by breathing as well as by other factors such as sweating or wet clothing. Worn clothing and perfumes emit VOCs (Volatile Organic Compounds). Therefore all of these aspects of air quality vary with the number of people present in the room. Every extra person that enters a room will add to the amounts of $CO_2$, humidity and VOCs present in the room. It will of course be appreciated that any of these factors may be taken on their own or a combination of them may be used to provide an overall measurement that relates to the presence of people.

The relationship between the aspect(s) of air quality and the number of people in the room may vary with certain factors such as the size and shape and contents of the room and the type of ventilation in use. However, the plurality of measurements may be used to estimate the relationship. In some examples estimating the occupancy of the room comprises: generating a model function by performing a curve fit on the plurality of measurements; and projecting the model function to obtain a projected steady state value of the aspect of air quality. It will be appreciated that over time the aspect of air quality that is affected by the number of people will reach a balance. This is because the ventilation replaces the air in the room with air from outside the room. When the occupancy of a room changes, there is a change in the rate of supply of contaminants (e.g. $CO_2$, humidity, VOCs, etc.). After some time that change will reach a balance when the contaminant supply equals the contaminant extraction. By using the plurality of measurements to generate a model function that models the aspect of air quality, the balanced state can be determined by projecting the model function into the future to a steady state value, i.e. to a time when that balance has been reached.

In some examples estimating the occupancy of the room is based on the projected steady state value. As the steady state value is based on a balance between the inputs and the outputs, the inputs are dependent on the number of people and the outputs are dependent on the ventilation rate, the steady state value depends on the number of people. Therefore the projected steady state value of the model function can be used to determine the number of people currently occupying the room.

The model function may take several forms and the best form of model function may depend on the underlying theoretical relationship that is expected. For example a polynomial model function of various orders could be used. However, in some examples the model function is an exponential function; and wherein generating the model function comprises estimating a time constant of the exponential function from the plurality of measurements. An exponential model function fits well with the theory where each person is considered to be a constant source of contaminants and where the ventilation extracts air at a constant rate. The resulting exponential function may include a term of the form $$e^{-\frac{t}{\tau}}$$

where t is time; and $\tau$ is the time constant of the exponential function.

The exponential function may be a falling (or descending) exponential with a form $$A + Be^{-\frac{t}{\tau}}.$$

This typically represents the relationship after one or more persons has left the room so that the supply of contaminants is reduced. Alternatively, the exponential function may be a rising exponential that rises to a steady state, e.g. in the form $$A + B\left(1 - e^{-\frac{t}{\tau}}\right).$$

This typically represents the relationship after one or more persons has entered the room so that the supply of contaminants is increased.

It will be appreciated that other parameters of the model function may also be estimated such as an initial value (or some other time-specific value) or a gradient at a particular time.

In some examples, the method further comprises: calculating an estimated ventilation rate from the estimated time constant. The time constant determines how rapidly the aspect of air quality changes with time, i.e. it determines the gradient. The time constant is dependent on the ventilation rate and the size of the room and does not depend on the number of people. Therefore the time constant of the model exponential function can be used to estimate the ventilation rate in the room. Accordingly, in some examples, calculating the estimated ventilation rate comprises calculating the estimated ventilation rate from the estimated time constant and a size of the room. The size of the room may be provided in a number of different ways, e.g. as a volume, or as an area (if ceiling heights are constant), or some other size indicator such as a size on a scale (small, medium, large). It will be appreciated that a volume measurement will generally give the most accurate results.

In some particularly advantageous examples, the estimated ventilation rate is used as the room ventilation rate parameter. This can then be used in the estimation of the occupancy based on the plurality of measurements. Thus by performing a curve fit and generating a model function, the occupancy of the room can be estimated. For example, in some examples, using the principles set out above, an exponential model function can be generated by curve fitting the plurality of measurements. A time constant of the exponential model function can be used together with the room size to calculate a room ventilation rate. Then the projected steady state value of the exponential model function can be combined with the calculated room ventilation rate to estimate the occupancy of the room.

In some examples, the ventilation rate can be estimated from other sensors. For example, pressure sensors can be used to detect changes in pressure within a room that occur when the ventilation is switched on and/or switched off. For example, there may be a drop in pressure within the room when an extractor fan is turned on and starts to expel air out of the room. The magnitude of the pressure drop may be used to determine the strength of the ventilation and therefore the ventilation rate. In other examples, there may be a rise in pressure within the room when a positive pressure ventilation system is turned on and starts to supply fresh air into the room. The magnitude of the pressure rise may be used to determine the strength of the ventilation and therefore the ventilation rate. It will be appreciated that the same principles may be used to detect changes in pressure due to the stopping of the ventilation. Other sensors may be used as part of ventilation detection and estimation. For example, a sound detector (e.g. a microphone) may be used to detect the sound of the ventilation running and can be used to determine the start and/or stop times of the ventilation. This can for example be used together with the pressure measurements from a pressure sensor to determine the pressure changes that occur as a result of the start and/or stop of the ventilation system. In some examples, pressure is measured both inside the room and outside the room (which may still be within the building, or may be outside the building). The differential pressure between inside and outside the room gives a good indicator of the operation/inoperation of ventilation and may be used to determine the relative strength of that ventilation. Sound detectors such as microphones can also be used to detect other sounds related to occupancy such as the sound of voices and/or the sound of doors opening or shutting. Such sounds may be detected by means of pattern matching systems. The detection of voices and doors can be used to determine the start and/or stop times of meetings more accurately or time points at which the occupancy may have changed. This may be indicative of the need to adjust or recalculate a model function and/or time constant and recalculate the occupancy accordingly. In some examples, two microphones may be used. A high sensitivity microphone may be used to detect the ventilation sound while a lower sensitivity microphone may be used for voice and/or door sound detection.

In some examples the method may further comprise: acquiring a stored room ventilation rate parameter from a memory. Acquiring a room ventilation rate parameter from a memory may in some cases be more accurate or more reliable than simply calculating it from the estimated model function (although a stored parameter from the memory may be used or combined with a calculated parameter too). For example, the room ventilation rate may be known from the ventilation system itself, e.g. through a setting or measurement, or it may be programmed into or selected on a ventilation controller or building management system. In such cases, an accurate room ventilation rate can be acquired and used without needing to estimate from the plurality of measurements of air quality. It will be appreciated that the stored value may be in the form of a ventilation rate (e.g. in litres per minute or cubic metres per hour or similar) or it may be in the form of a related parameter such as a time constant as discussed above. Conversion between the two is readily possible.

The memory may take many forms, e.g. various types of ROM or RAM or physical storage media. The data may be stored on the memory in any of a number of forms, e.g. as a heap or stack or array. Storing and extracting data from the memory will of course depend on the form of the storage and can be selected appropriately. In some embodiments, the memory comprises a lookup table of stored room ventilation rate parameters and wherein acquiring a stored room ventilation rate parameter comprises selecting said parameter from the lookup table based on at least one of: a trend direction of the plurality of measurements, a ventilation operating mode, an estimated ventilation rate, a current time, a current date and/or a current day of the week. In some examples a trend direction may include an upward trend, a downward trend or a steady trend. It will be appreciated that further categories may be included if desired, e.g. different degrees of steepness of the trend, or accelerating or decelerating trends. In some embodiments a ventilation operating mode may include a simple indicator of on or off, i.e. whether the ventilation is in use or not. In other embodiments the ventilation operating mode may include further detail, e.g. a trickle mode, standard mode, boost mode, or other levels of ventilation strength or power. A current time may be a time of day (e.g. in hours, minutes, and/or seconds), a current date may be a calendar date comprising one or more of: current year, current month within the year and/or current day within the month. A current day of the week may be an indication of whether the day is a Monday, Tuesday, Wednesday, etc. It will be appreciated that building use can vary according to these various time-measurement parameters. For example, building use on a Saturday/Sunday is typically different from Monday-Friday in many office buildings. Certain dates such as public holidays may also be different, regardless of the day of the week. Certain times of day are also typically different. For example 8 am to 6 pm may be the busiest times of the day for an office building. Selecting a room ventilation rate parameter from the lookup table based on any of these factors allows a most suitable ventilation rate for the expected conditions to be looked up and used.

In some embodiments the memory comprises at least one histogram of room ventilation rate parameters acquired from previous events in the room; and wherein acquiring the room ventilation rate parameter from the memory comprises selecting a room ventilation rate parameter from one of the at least one histograms. A histogram may comprise a plurality of ranges (e.g. of ventilation rates or time constants or some other representative parameter) and a corresponding frequency or count value for each range, i.e. to indicate how often the parameter tends to fall within that particular range. This effectively provides a spread across a large range of ventilation rate parameters with an indication of the probability of each particular range of ventilation rate parameters occurring. A single histogram may be provided or several histograms may be provided, each representative of a different scenario. In such cases, a histogram is first selected, then a parameter value is selected from the selected histogram.

In some embodiments the memory comprises at least one histogram for rising measurements of air quality and at least one histogram for falling measurements of air quality, and wherein the method comprises selecting a histogram for rising measurements of air quality when the plurality of measurements are rising and selecting a histogram for falling measurements of air quality when the plurality of measurements are falling. As noted above, there may be just one histogram for rising measurements of air quality and one for falling measurements of air quality or there may be multiple histograms for each, each representing a different degree of rising/falling. Choosing between a rising histogram and a falling histogram is particularly beneficial as these tend to represent quite different scenarios. Rising measurements (e.g. of $CO_2$, VOCs, humidity, etc.) tend to represent the situation where people have entered a room and the concentration within the room has not yet stabilised with the ventilation, i.e. where the sources of these contaminants are dominant over the ventilation. Falling measurements tend to represent the situation where people have left the room and the ventilation is now dominant over the sources.

In some embodiments the memory comprises different histograms for different operating states of mechanical ventilation, and wherein the method comprises selecting a histogram according to a determination of the current state of mechanical ventilation. The operational state of mechanical ventilation such as fans (for air input or air extraction) can have a significant impact on the room ventilation rate parameter. Therefore knowing whether the fan is on/off or whether the fan is in a particular mode (trickle/normal/boost) or is operating at a particular power level, can be useful in narrowing down the right room ventilation rate parameter to look up. It will be appreciated that the mechanical ventilation rate does not on its own necessarily define the ventilation rate of the room as other factors may also have an effect. For example, the open/closed state of a door or window has a significant effect on the ventilation rate (and this need not be a binary open/closed state, but could include a range or number of partially open states). Therefore, even where the mechanical ventilation rate may be known, there can still be a range, or distribution of possible ventilation rates or time constants (or other room ventilation rate parameters) in the room. The histogram can then store the frequency of occurrence of these parameters. The current state of mechanical ventilation may be known from a schedule or may be obtained from the ventilation itself or from a building management system. For example, a signal may be supplied and received to indicate the current operational state and/or mode and/or level of the mechanical ventilation.

In other embodiments there may be histograms for different times or for different days of the week or different days of the year or for different seasons, or for various other scenarios. It will of course be appreciated that these different scenarios may be combined in any combination, e.g. there may be one histogram for office times (e.g. 8 am to 6 pm) with ventilation high and another histogram for the same office times (8 am to 6 pm) with ventilation low. Similarly there may be further histograms for out-of-office hours (e.g. 6 pm to 8 am) with each of high ventilation and low ventilation. All of the above types of scenario may be combined so that an appropriate histogram can be selected. The number and type of histograms that is desirable and practical in any given implementation may be decided based on the expected uses.

In some embodiments each histogram of room ventilation rate parameters comprises: a plurality of parameter bins, each associated with a range of ventilation rate parameters; and for each parameter bin, a value indicating frequency of occurrence of ventilation rate parameters within the associated range. The parameter bins do not need to be the same size, i.e. each covering the same amount of range, but can instead be of different sizes or each cover different sizes of range. The value indicating frequency of occurrence may be a number, e.g. the number of times that a parameter within the corresponding bin has been noted or logged or estimated. The value indicating frequency of occurrence may instead by a probability value or the like indicating a relative probability of occurrence of a room ventilation rate parameter falling within that bin. The histogram thus essentially provides a probability distribution across the full range of ventilation rate parameters.

There are numerous ways in which to select a room ventilation rate parameter from the histogram (or from whichever histogram is selected if there is more than one). In some embodiments selecting the room ventilation rate parameter from the histogram comprises selecting a parameter bin having a peak frequency of occurrence value and selecting a parameter value representative of the selected parameter bin. For example, the peak frequency of occurrence value may be a global peak within the whole histogram or it may be a selected one of a plurality of peaks, e.g. it may be a local peak. When selecting a parameter value representative of the selected parameter bin, there are also numerous ways to do so. For example the representative value may be the start of the range of the bin or the end of the range of the bin or the mid-point of the range of the bin or indeed any other selected value within the range of the bin.

In some embodiments, selecting the parameter bin having a peak frequency of occurrence value comprises selecting a parameter bin having a local peak frequency of occurrence value closest to an estimated ventilation rate parameter.

In such cases an estimate of the ventilation rate parameter is first achieved by any suitable method. This may include the methods described above for estimating the ventilation rate parameter based on a curve fitting procedure. Sometimes the estimated parameter is accurate enough to use on its own. However, sometimes the estimated parameter will not be sufficiently accurate, but will be indicative of the approximate ventilation rate parameter. In such cases, the estimated rate can be used to look up in the histogram (or the most appropriate selected histogram if there are several to choose from) the nearest most commonly occurring value, i.e. a peak value (the most commonly occurring) that is a local peak (but not necessarily a global peak) closest to the original estimate. The histogram data may be acquired over time and therefore is strongly indicative of actual ventilation rates that occur, averaging out noise in the estimates and thereby providing a more accurate likely value of the ventilation rate parameter. As noted above, the estimated ventilation rate parameter may, in some embodiments, be the estimated time constant or the estimated ventilation rate specifically discussed above.

In some embodiments, the value selected from the histogram may be simply the most common value (most frequently occurring value) in the histogram or it may be the most common value in a particularly selected region of the histogram (e.g. based on knowledge of the current approximate ventilation rate which may be obtained as a signal from the ventilation device or a building management system or from measurements or estimates, such as knowledge that the fan is in high, medium or low ventilation mode, etc.).

In some embodiments, when selecting a value for the ventilation rate parameter from the histogram, the raw data in the histogram may be filtered before selecting the value. A filter may be applied to the data in order to smooth out noise in the data, e.g. to remove local peaks that are not sufficiently prominent to count as local peaks, thereby making the selection process simpler and more accurate. Accordingly, in some embodiments finding the peak frequency of occurrence value comprises filtering the frequency of occurrence values to smooth the data and then finding a peak in the filtered data.

The histogram may be obtained from any source. For example, a default or customised histogram may be provided for a given room, e.g. customised based on the room size and known ventilation equipment. However, for better accuracy, the histogram may be built up over time for a particular room. For example, every time a room ventilation rate parameter is estimated, e.g. using the above techniques such as curve fitting a plurality of measurements (or by other techniques) the estimated ventilation rate parameter can be added to the histogram as a count, or increase in probability (increase in frequency of occurrence) in the appropriate bin. If several histograms are being used, then the estimated parameter is logged in any (possibly multiple) corresponding histograms. For example an estimated parameter may be logged in a Tuesday histogram as well as an "office hours" histogram and potentially also a "Tuesday office hours" histogram for particularly specific data. Over time, as more data is acquired, the histogram(s) will become more accurate with reduced noise so that selection of the most frequently occurring value will become a more accurate indicator of the most likely ventilation rate that corresponds to the current situation.

As noted above, sometimes the estimated value will be accurate on its own, while at other times, it may be insufficiently accurate and it is then preferred to lookup in a lookup table or histogram. Accordingly, in some embodiments the method comprises steps of: curve fitting the plurality of measurements to generate a model function; calculating a quality of the curve fit; and based on the calculated quality of the curve fit, determining whether to i) calculate a room ventilation rate parameter from the model function or ii) acquire a room ventilation rate parameter from the memory. The quality of the curve fit will indicate how good the measurements are and therefore how accurately the curve fits the model. A good curve fit will give a good predictor of the steady state and the gradient will give a good indicator of the time constant. The corresponding estimate of room ventilation rate will be accurate on its own. On the other hand, where the curve fit is of insufficient quality, it may be preferred to consult the memory (e.g. lookup table or histogram). The quality of curve fit may be measured in any of many known ways, e.g. using a root mean squared error or the like. The calculated quality of curve fit may then be compared against a threshold value to determine if it is of sufficient quality. It will be appreciated that in this method, the calculation of the room ventilation rate parameter may be according to any of the methods described above. Also, the acquisition of a room ventilation rate parameter from memory may be according to any of the methods described above. It will further be appreciated that a combined approach may also be taken, e.g. combining a calculated room ventilation rate parameter with one acquired from the memory. These values may be combined using an average or weighted average or any other suitable method of combination.

In some embodiments, the current ventilation state may be assessed in certain ways to assist in determining the most appropriate room ventilation rate parameter. For example, measurements of radon and/or VOC concentration may be used to assess whether or not mechanical ventilation is on or off (or indeed at what level/strength it is operating). For example, radon levels and VOC levels are typically higher when there is no ventilation to remove them. Radon is emitted from natural sources such as Uranium-238 in the ground. VOCs are emitted by certain permanent elements within a room such as carpets and furniture. The variations in these measurements can therefore be used to determine the current ventilation status of the room. For example, such measurements may be able to detect when mechanical ventilation is on or off and may also be able to determine events such as the opening or closing of a window or door as these will also cause sharp changes in ventilation. Additional sensor fusion, e.g. using temperature, humidity, light, sound and/or pressure sensors can also lead to improved detection of such events and/or changes in ventilation in a room. In particular, sound and pressure sensors can be used as discussed in more detail above. Typically the best results are obtained when data from multiple sources is all combined, e.g. combining the measurements from radon, VOCs, pressure and sound.

According to another aspect, the invention provides a system for of estimating occupancy of a room, comprising:

a processor; and a memory;

wherein the memory comprises instructions which when executed by the processor cause the processor to:

acquire a plurality of measurements of an aspect of air quality in the room; and estimate the occupancy of the room based on the plurality of measurements and a room ventilation rate parameter.

According to yet another aspect, the invention provides software comprising instructions which when executed on a computer, cause the computer to:

acquire a plurality of measurements of an aspect of air quality in the room; and estimate the occupancy of the room based on the plurality of measurements and a room ventilation rate parameter.

It will be appreciated that all aspects of the method discussed above also apply to the system and software for estimating occupancy. This may of course also include any of the preferred or optional features discussed above.

Preferred embodiments of the invention will now be described, by way of example only, and with reference to the accompanying drawings in which:

FIG. 1 illustrates the principles of contaminant flow in a room. The principle is described here in relation to $CO_2$, but this is purely by way of example and the principle applies similarly to other contaminants or measures of air quality such as VOCs and humidity.

Figure 1:
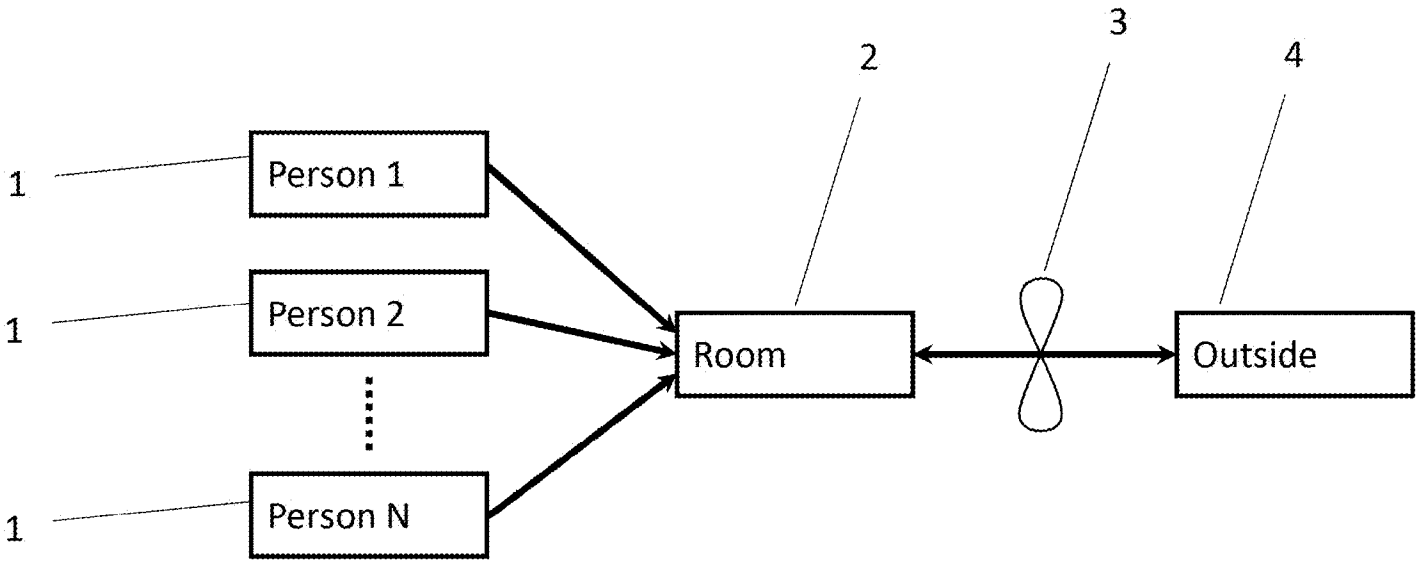
FIG. 1 illustrates the principles of contaminant flow in a room.

Each person 1 in a room 2 is a source of $CO_2$. As they breathe, they generate $CO_2$ at a fairly constant rate and that $CO_2$ is stored in the room 2 until it is removed by some other mechanism. The mechanism for removal is represented here by a fan 3 which removes air (including $CO_2$) to the outside 4. It will be appreciated that the fan 3 is representative of any air exchange mechanism. It may be mechanical ventilation such as an extractor fan that draws air out of the room 2 or it can represent natural ventilation such as by air movement through and around doors, windows, vents, etc. It may also represent the increased air movement through such orifices due to a positive pressure ventilation system (which supplies fresh air to the room 2) or it may be part of a balanced ventilation system that extracts air from the room at the same time as supplying replacement air. Air that is extracted from the room is replaced typically with air from outside (which may or may not be filtered). Thus in many cases the lowest concentration of $CO_2$ (or other contaminant) in the room 2 will be the concentration found in the outside 4 in the vicinity of the room 2 (or the building in which the room 2 is located).

The contaminant supply and extraction from the room 2 may be modelled in different ways. In the following example, the rate of supply for a person is assumed to be constant, the concentration outside is assumed to be constant and the air extraction rate is assumed to be constant.

The concentration of $CO_2$ within the room may thus be modelled by the following equations:

Firstly, in the case of a rising level of $CO_2$ when one or more persons 1 enters a room 2 (e.g. at the start of a meeting), the $CO_2$ concentration in the room may be modelled as:

$$C_{room} = C_{outside} + \frac{Nx}{R}\left(1 - \exp\left(-\frac{tR}{V}\right)\right) + (C_{start} - C_{outside})\exp\left(-\frac{tR}{V}\right)$$

Secondly, in the case of a falling level of $CO_2$ when one or more persons 2 leaves the room 2 (e.g. at the end of a meeting), the $CO_2$ concentration in the room may be modelled as:

$$C_{room} = C_{outside} + C_{start}\left(1 - \frac{C_{outside}}{C_{start}}\right)\exp\left(-\frac{tR}{V}\right)$$

Where:

$C_{room}$ is the $CO_2$ concentration in the room 2 (e.g. in kilograms per cubic metre);

$C_{outside}$ is the $CO_2$ concentration outside (i.e. at the source of replacement air);

$C_{start}$ is the $CO_2$ concentration in the room 2 at the start of the meeting;

N is the number of people in the room;

x is the $CO_2$ output rate of one person (e.g. in kilograms per second);

R is the rate of air extraction from the room (e.g. in cubic metres per second);

V is the volume of the room (e.g. in cubic metres); and t is time.

This model can also be used for concentrations of other contaminants supplied at constant rate, e.g. VOCs or humidity. These are all contaminants that are emitted by people, e.g. $CO_2$ through breathing, humidity through breathing and sweating, VOCs from clothing.

Figure 2:
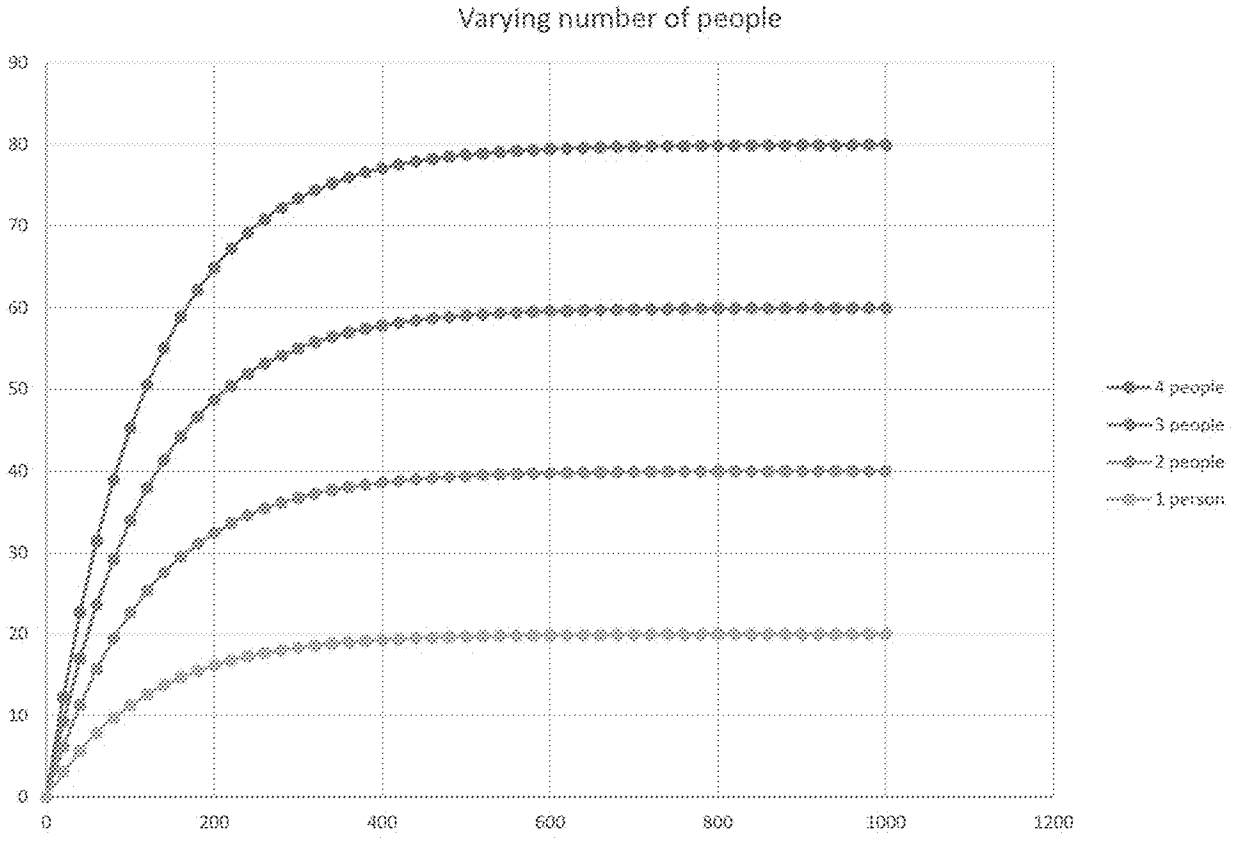
FIG. 2 illustrates how contaminant concentration varies with number of people in a room in a rising concentration scenario.

When people enter a room at the start of a meeting, the $CO_2$ (or other contaminant) concentration will start to increase. The initial rate of increase depends on the number of people in the room (i.e. on the total supply rate of $CO_2$). More people will result in a steeper (faster) rise in $CO_2$ concentration. The rate of increase also depends on the room volume. In the initial stages, the rate of increase of concentration can be taken to be proportional to each of the number of people and the room volume. However, as the concentration of $CO_2$ in the room rises, the rate of extraction via the ventilation/air exchange also increases the rate of removal of $CO_2$ until eventually an equilibrium is reached where the rate of supply of $CO_2$ from people in the room equals the rate of removal of $CO_2$ by the ventilation. The equilibrium concentration depends on the number of people in the room and the efficiency of the ventilation (i.e. on the rates of supply and extraction), but it does not depend on the room size (room volume). FIG. 2 shows the $CO_2$ concentration (vertical axis) over time (horizontal axis) from the start of a meeting (with an assumed starting $CO_2$ level of zero for simplicity). The different curves show the variation in concentration for different numbers of people in the room (from 1 person up to 4 people). The same ventilation rate applies to all of these curves in FIG. 2. It can clearly be seen that the equilibrium concentration varies with the number of people in the room. Therefore, if one knows the equilibrium $CO_2$ concentration and the ventilation rate then one can estimate the number of people in the room. Thus the $CO_2$ data recorded in a room can be used to estimate the occupancy of the room.

Figure 3:
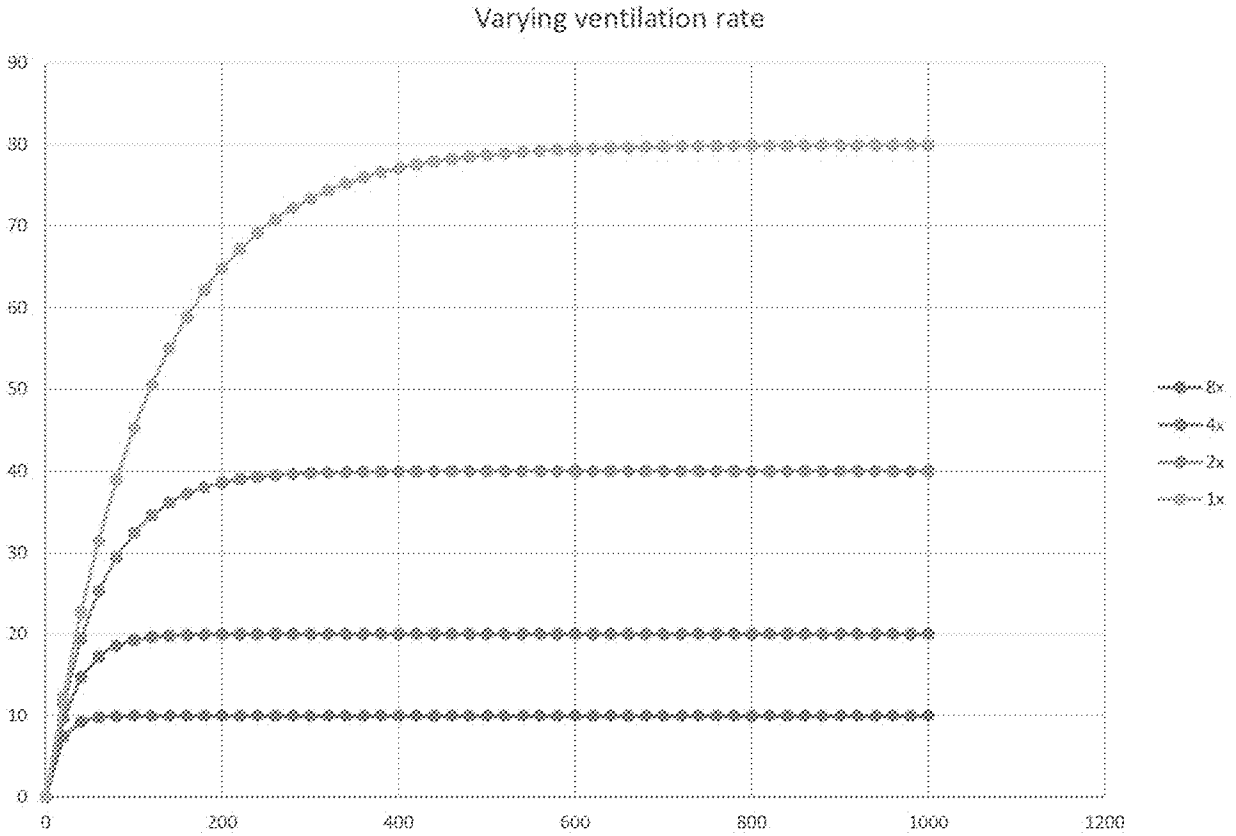
FIG. 3 illustrates how contaminant concentration varies with ventilation rate in a rising concentration scenario.

FIG. 3 is similar to FIG. 2, but shows how the $CO_2$ equilibrium concentration varies with the ventilation rate. These curves in FIG. 3 are all for the same number of people in the room, but just with different ventilation rates applied (with the curves showing a basic ventilation rate labelled '1×' and multiples of that ventilation rate 2×, 4× and 8×). It can clearly be seen that higher ventilation rates reduce the final equilibrium concentration.

By taking a plurality of measurements of $CO_2$ (or of other aspects of air quality) in the room 2, a set of data points over time can be acquired and a curve fitting process can be used to determine certain parameters of a model function. The equilibrium state can then be predicted from the model function by extrapolation rather than having to wait for the $CO_2$ concentration level in the room to actually reach equilibrium before determining occupancy. Thus, curve fitting allows earlier determination of occupancy.

Different model functions can be used to fit to the measured data points. Some embodiments could use a polynomial curve fit. However, as the theory above predicts an exponential curve, the curve fitting described here is also an exponential curve fit, i.e. the curve fitting process attempts to find an exponential curve that best fits the measured data points. One important parameter of the exponential curve that needs to be determined is the time constant of the exponential curve. The time constant is the value $\tau$ in a curve of the from $\exp(-t/\tau)$. Thus, in the above equations, the time constant is V/R, i.e. the volume of the room divided by the ventilation rate for the room. It can therefore be seen that if one knows the volume of the room 2, then a time constant obtained from the curve fitting procedure can be used to calculate the ventilation rate. As discussed above, the ventilation rate is one factor in determining the equilibrium level of the $CO_2$ concentration. Therefore, by curve fitting to obtain a model function with a particular time constant and extrapolating the model function to find the equilibrium value, the only other information required to determine the occupancy of the room is the volume of the room. Such information is readily measurable in advance and generally doesn't change over time (although some temporary spaces can be adjusted or conference rooms can be temporarily partitioned).

Figure 4:
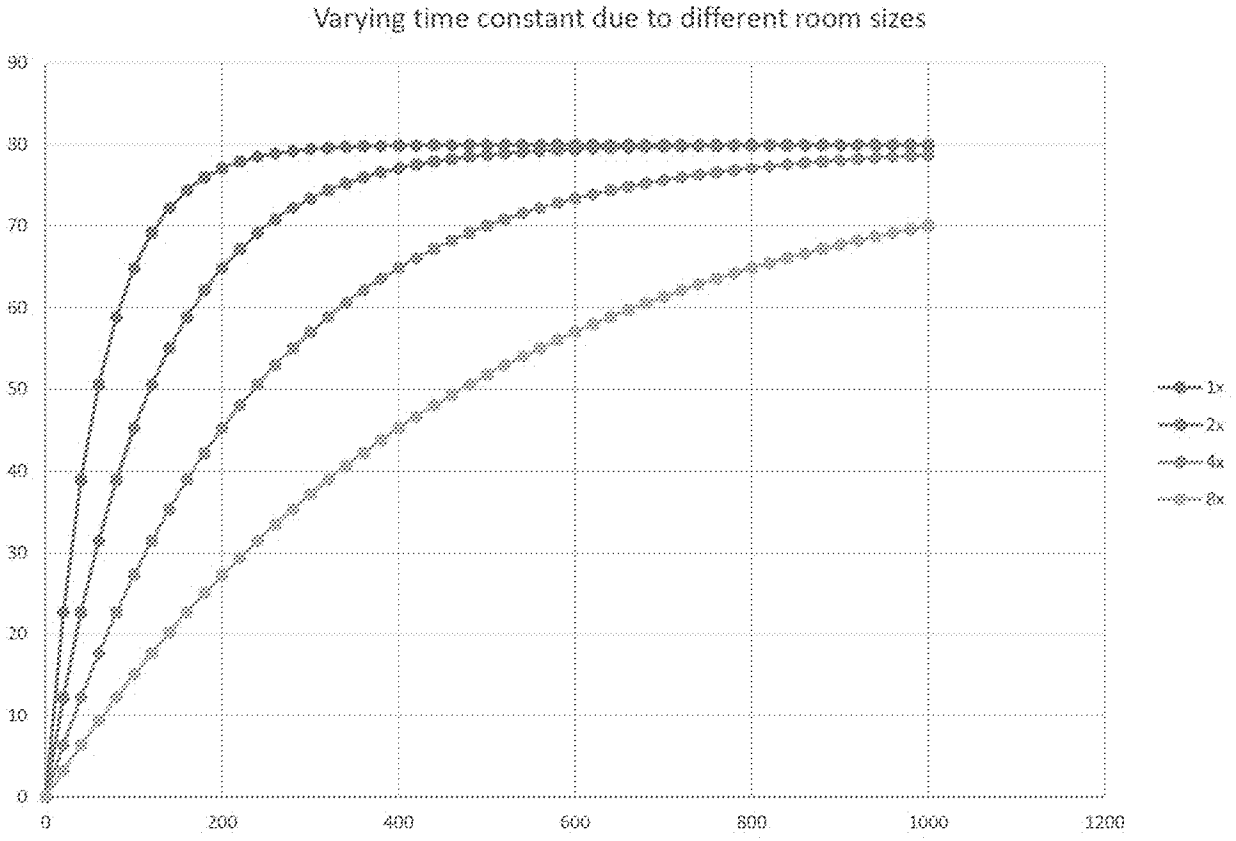
FIG. 4 illustrates how contaminant concentration varies with time constant in a rising concentration scenario for different rooms.

FIG. 4 shows how $CO_2$ concentration varies with different time constants. The curves are all for the same number of people and the same ventilation rate (and hence all curves settle to the same equilibrium value. However, the time constants are different due to different room volumes. A basic curve is shown, labelled '1×' and the other curves are for multiples (2×, 4× and 8×) of that basic time constant. It can be seen that a lower time constant (which corresponds to a smaller room) results in a steeper (faster) rise towards the equilibrium level.

Figure 5:
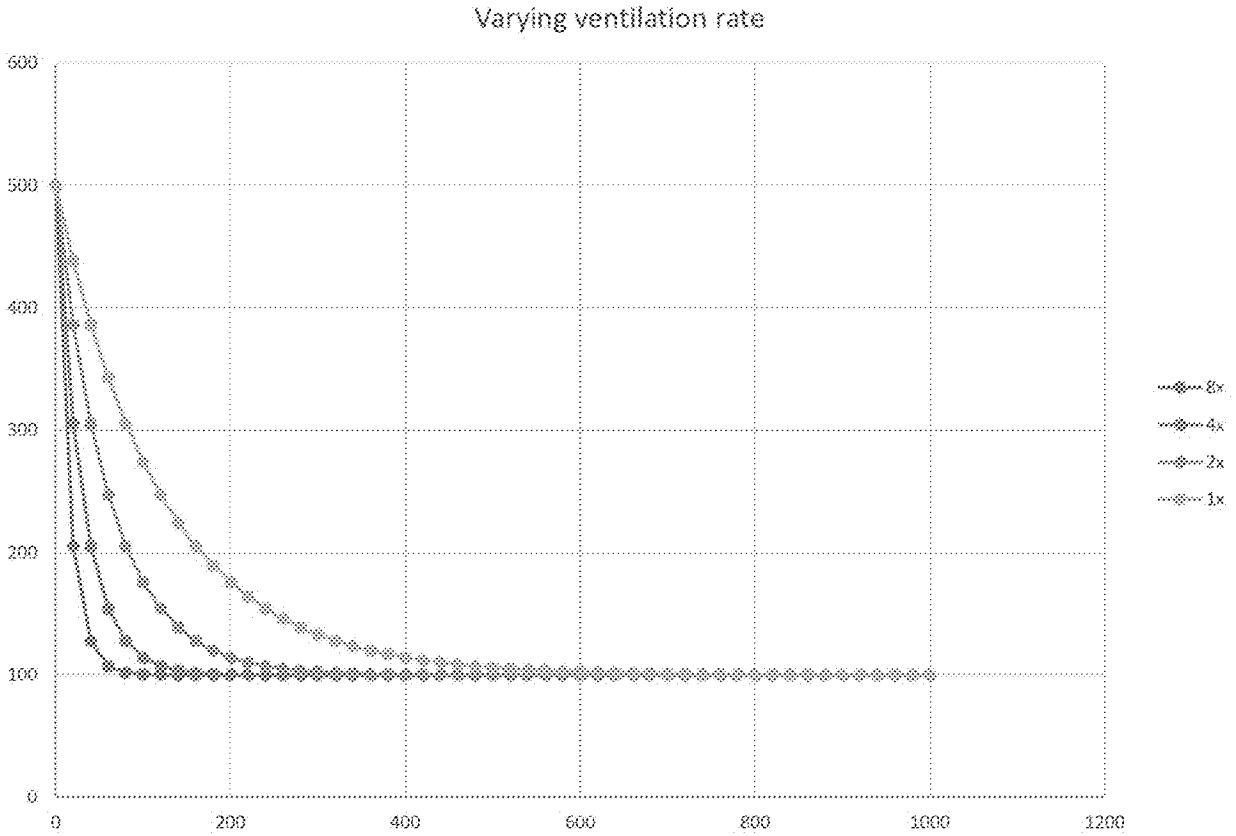
FIG. 5 illustrates how contaminant concentration varies with ventilation rate in a falling concentration scenario.

In the case of falling $CO_2$ concentration, e.g. at the end of a meeting when everyone leaves, or if somebody leaves during a meeting at a time when their departure causes an overall drop in the $CO_2$ concentration, the concentration is modelled by a falling exponential curve rather than a rising exponential curve. In this case the time constant of the concentration curve once again depends on both the room volume and the ventilation rate. The number of people in the room only affects the end concentration (i.e. the new equilibrium value). FIG. 5 shows how $CO_2$ concentration falls from an initial value to a new final value for different ventilation rates (which in turn means different time constants). The curves show a curve labelled '1×' for a basic ventilation rate and other curves for multiples (2×, 4× and 8×) of that basic ventilation rate. It can be seen that a higher ventilation rate results in a steeper (faster) drop towards the new equilibrium concentration.

Figure 6:
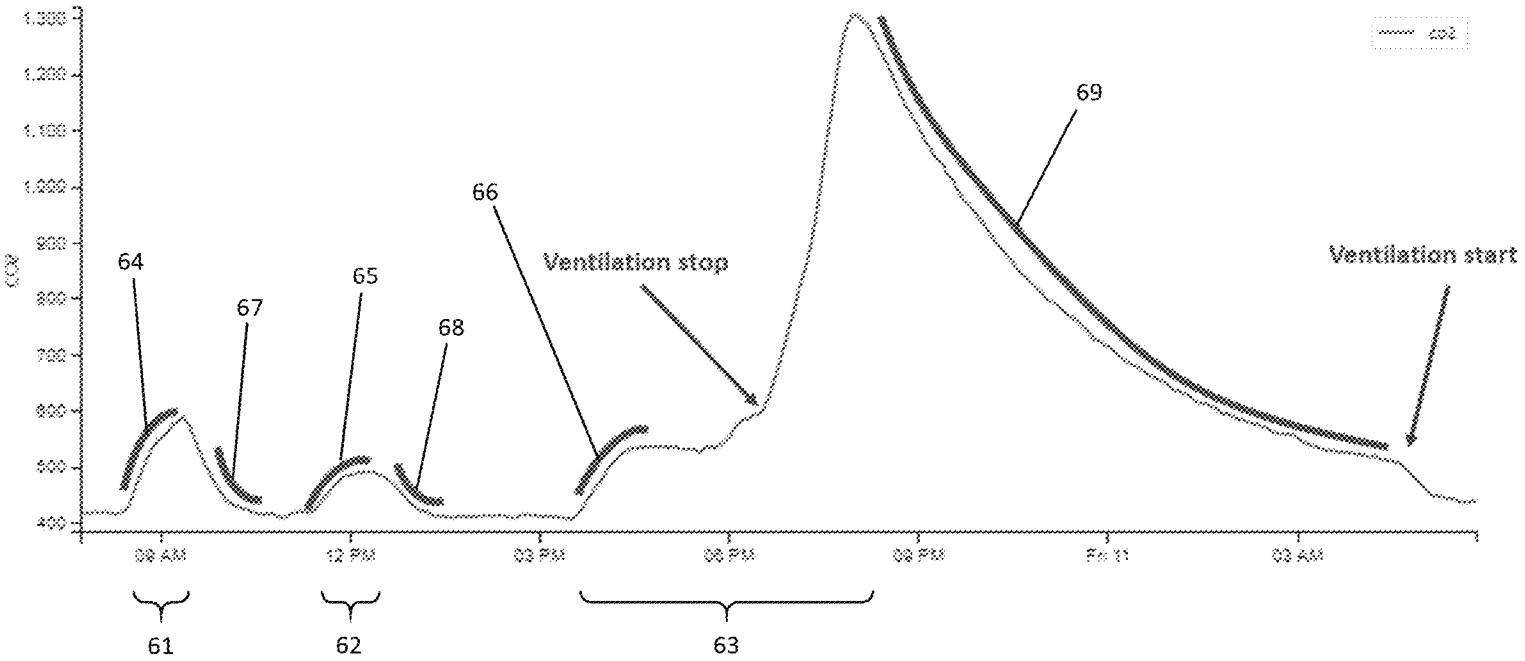
FIG. 6 shows example data of $CO_2$ concentration in a room over the course of a day.

FIG. 6 shows an example data set of $CO_2$ concentration measurements from a single room 2. Three meetings took place during this time: Meeting one 61 from around 0830 to 0930, meeting two 62 from around 1130 to 1230 and meeting three 63 from around 1530 to around 2000. Each of these meetings 61, 62, 63 starts from a base level of $CO_2$ of around 420 ppm and an increase in $CO_2$ concentration can be seen at the start of each meeting in the form of an approximate increasing exponential, progressing towards an equilibrium level. In addition, at the end of each meeting there is a corresponding decreasing exponential curve from the peak concentration reached during the meeting back down to the base level of 420 ppm. Meeting three 63 is further complicated by the fact that the mechanical ventilation in the building stopped around 1900 resulting in a further increase in $CO_2$ concentration even though nobody left the meeting. Meeting three 63 also shows a clear plateau from around 1630 to 1900 where the equilibrium level was reached prior to the change in ventilation rate. The subsequent falling $CO_2$ concentration after meeting three 63 is correspondingly longer due to the larger starting value and the lower ventilation rate. However, it can be seen that the ventilation turns back on again around 0500 the following day which causes a change (steepening) of the falling exponential and a rapid return to the base level of 420 ppm. Six portions of the $CO_2$ graph in FIG. 6 have been indicated as corresponding to changes in the number of people in the room 2. Three rising exponentials 64, 65, 66 are indicated, corresponding to meetings one 61, two 62 and three 63 respectively. Three falling exponentials 67, 68, 69 are indicated corresponding to meetings one 61, two 62 and three 63 respectively. Each of these six curves 64-69 can be modelled as discussed above. Thus, for example, for each curve 64-69 a plurality of measurements can be acquired, it can be determined whether the curve is a rising exponential or a falling exponential, a curve fitting procedure can be applied to generate a model function and determine a time constant of the exponential, a known room size can be used to calculate the ventilation rate from the time constant, the model function can be extrapolated to determine the equilibrium $CO_2$ concentration and that value can be used to determine the number of people currently in the room.

Figure 7:
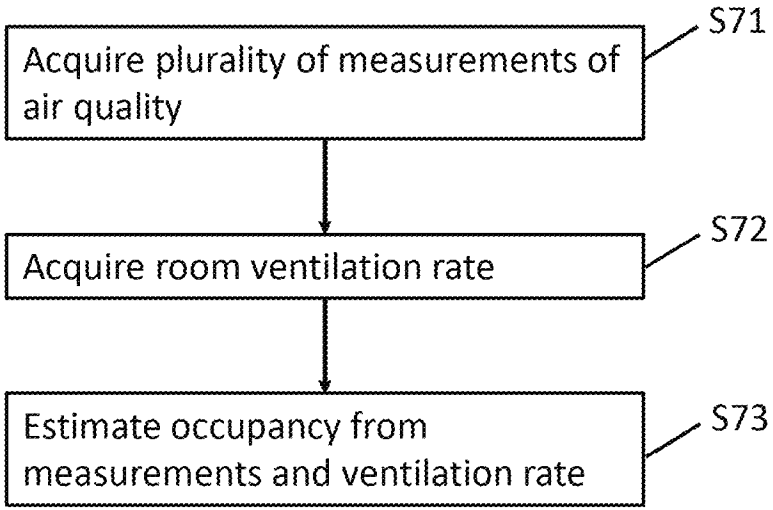

FIG. 7 shows a method of estimating occupancy of a room 2 in its most general form. In step S71 a plurality of measurements of air quality are acquired. These measurements may be acquired from any suitable sensor or from a set of sensors, optionally using some form of sensor fusion. In step S72 a room ventilation rate is acquired. In this general method, the ventilation rate may be acquired in any of a number of ways, e.g. as a known rate or a measured rate or a scheduled rate.

Finally, in step S73 the occupancy of the room 2 is estimated using the plurality of acquired measurements of air quality and the acquired room ventilation rate.

Figure 8:
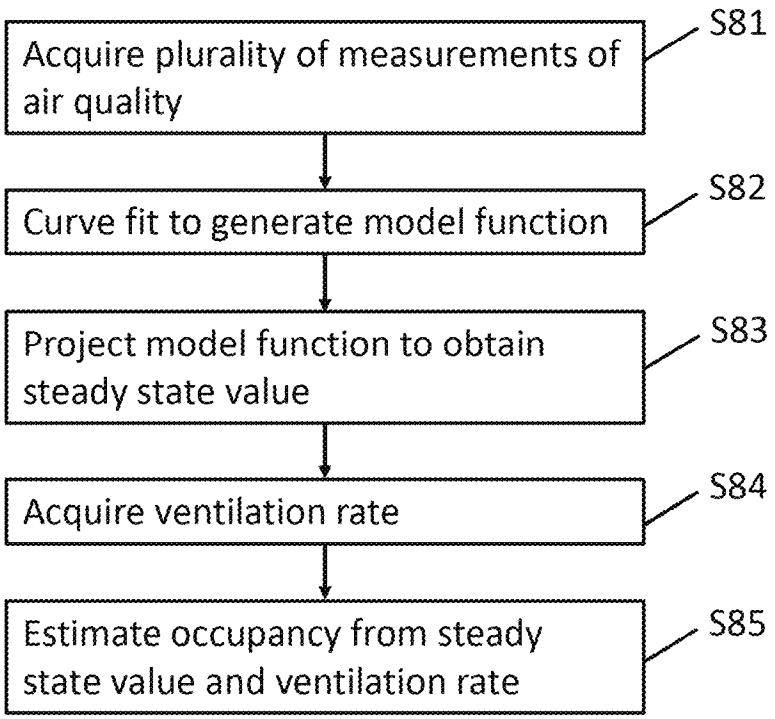
FIGS. 7-11 show flow diagrams of various methods for estimating occupancy within a room.

FIG. 8 shows one example embodiment of a method of estimating occupancy of a room 2 in more detail. In step S81 a plurality of measurements of air quality are acquired, the same as in step S71. In step S82 a curve fitting procedure is used on the acquired measurements to generate a model function that fits the measurements. In step S83 the model function is projected forwards in time to obtain a steady state value representative of the eventual balanced state between supply and extraction. In step S84 a ventilation rate is acquired, the same as in step S72, and finally in step S85 the occupancy of the room 2 is estimated using the steady state value and the acquired room ventilation rate.

Figure 9:
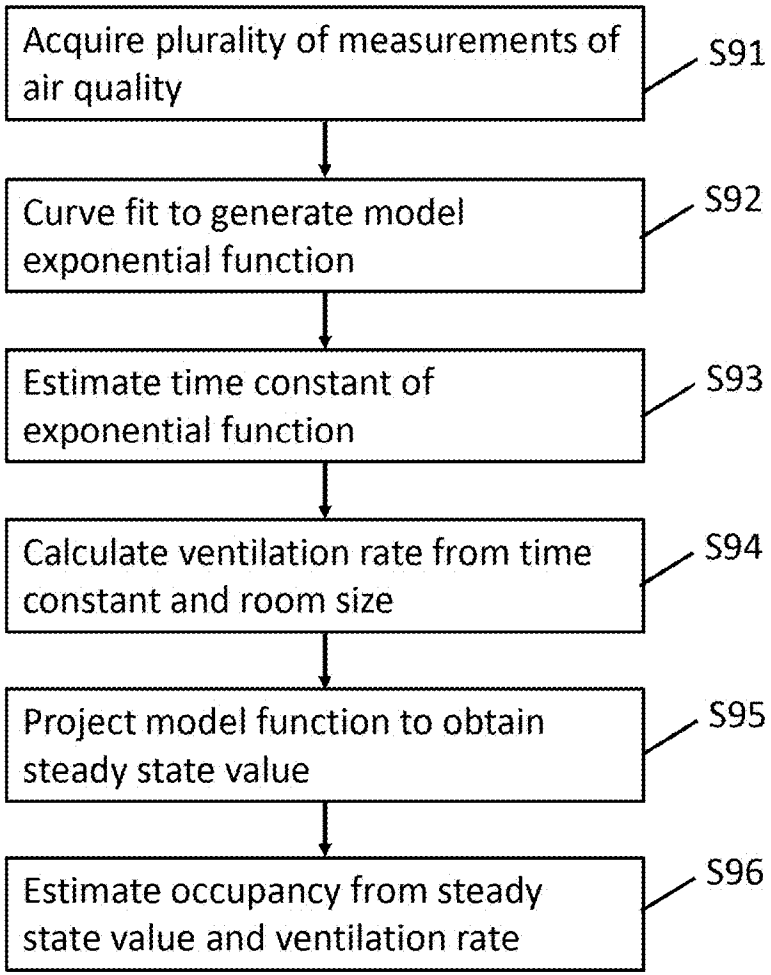

FIG. 9 shows another example embodiment of a method of estimating occupancy of a room 2 in more detail. In step S91 a plurality of measurements of air quality are acquired, the same as in steps S71 and S81. In step S92 a curve fitting procedure is used on the acquired measurements to generate a model exponential function that fits the measurements. In step S93 a time constant of the exponential function is estimated. In step S94 the estimated time constant is used together with the room size to calculate a ventilation rate of the room. As discussed above, the ventilation rate may be calculated as the room volume divided by the estimated time constant. In step S95 the model function is projected forwards in time to obtain a steady state value representative of the eventual balanced state between supply and extraction, the same as step S83. Finally, in step S96 the occupancy of the room 2 is estimated using the steady state value and the calculated room ventilation rate. This method is particularly beneficial as the only input required for the algorithm (apart from the plurality of measurements of air quality) is the size of the room. The size of the room can easily be input in advance either from measurements or from known data about the building. Alternatively, room size can be obtained in a calibration step using a known ventilation rate and a known source of $CO_2$ (or other contaminant), e.g. a known number of people in the room. In some cases, over time, room size can be derived from other measurements. For example, as the equilibrium level depends on the number of people, after a significant number of measurements it may be reasonable to assume that the lowest equilibrium level corresponds to an occupancy of 1 person and the corresponding ventilation rate can be calculated. The corresponding time constant that led to that equilibrium level can then be used to calculate the room size from the calculated ventilation rate.

It can also be appreciated that, even without a known volume for the room, a relative occupancy can still be calculated, i.e. it can be readily established whether the current occupancy is greater than or less than one or more previous measurements and by how much. Thus, until a volume of the room is obtained (whether by measurement, other data input or inference from several measurements) the relative occupancy can still be output in place of an absolute occupancy.

Figure 10:
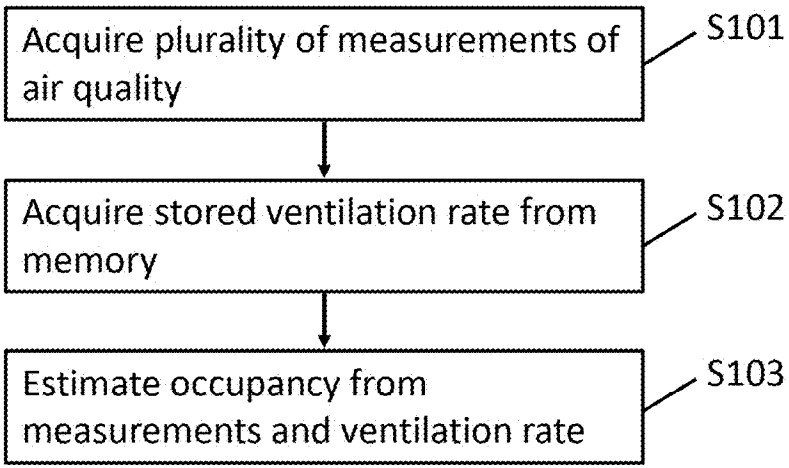

FIG. 10 shows another example embodiment of a method of estimating occupancy of a room 2. This example is similar to the example of FIG. 7 except that the room ventilation rate is specifically acquired from a memory. Thus in step S101 a plurality of measurements of air quality are acquired, the same as in steps S71, S81 and S91. In step S102 a stored ventilation rate is acquired from memory. The stored ventilation rate may have been acquired in any of a number of different ways, e.g. from previous measurements or calibrations or from a commanded ventilation rate defined by a building controller or the like, or from technical documentation relating to the ventilation system. In step S103 the occupancy of the room 2 is estimated using the plurality of measurements of air quality and the acquired ventilation rate, similar to step S73.

Figure 11:
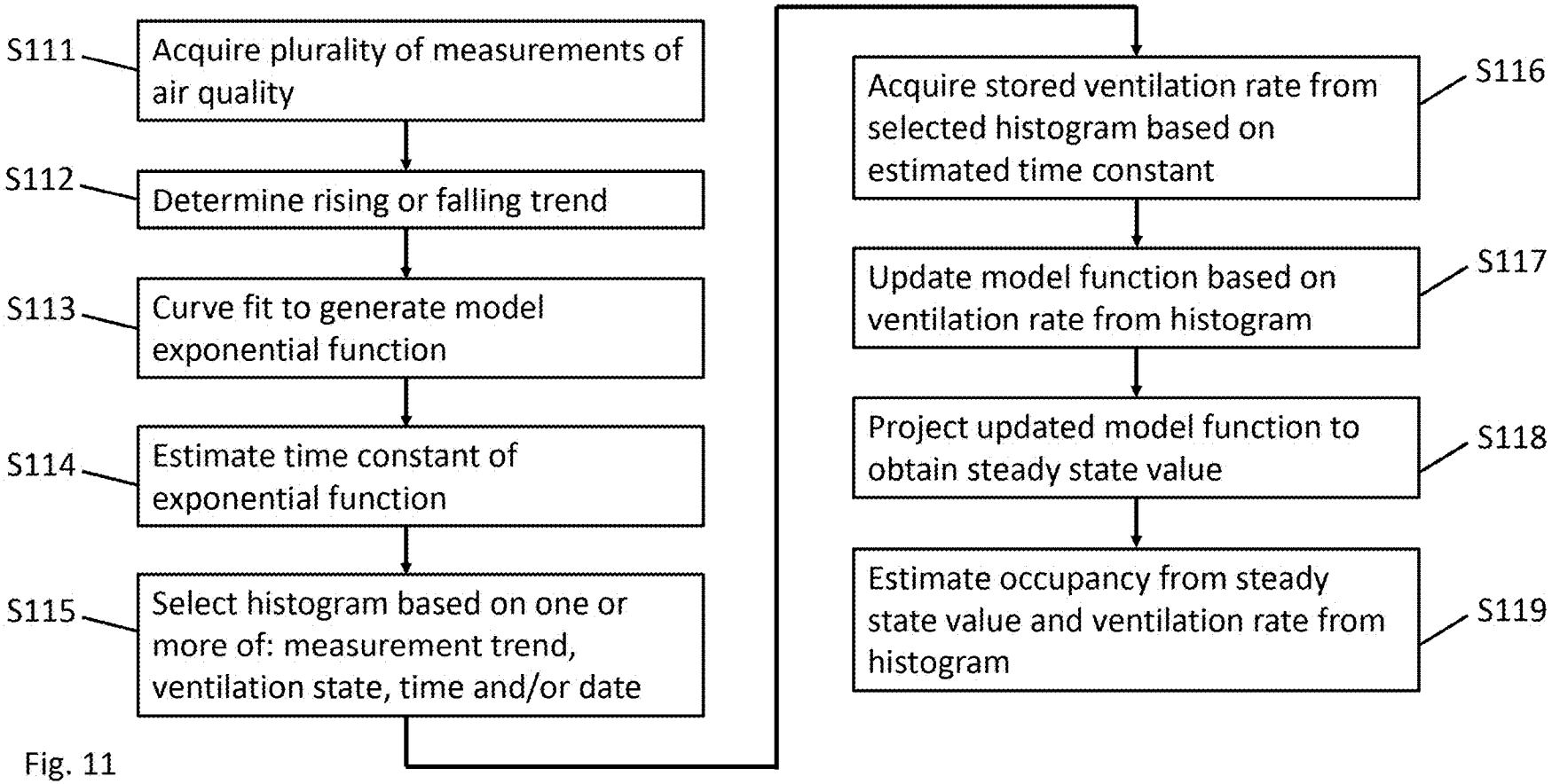

FIG. 11 shows another example embodiment of a method of estimating occupancy of a room 2 in more detail. In step S111 a plurality of measurements of air quality are acquired, the same as in steps S71, S81, S91 and S101. In step S112 the plurality of measurements is evaluated to determine if the trend is rising or falling. A rising trend is indicative of people entering the room (i.e. increasing occupancy) and a falling trend is indicative of people leaving the room (i.e. decreasing occupancy). In step S113 a curve fitting procedure is used on the acquired measurements to generate a model exponential function that fits the measurements. If the trend identified in step S112 was a rising trend then the model function will be a rising exponential and if the trend identified in step S112 was a falling trend then the model function will be a falling exponential. In step S114 a time constant of the exponential function is estimated. In step S115 a histogram is selected based on one or more of a number of different factors. These factors may include measurement trend, ventilation state, time and date. For example the selected histogram may be one associated with a rising trend or it may be one associated with a falling trend. The selected histogram may be one associated with various ventilation states, e.g. ventilation off or ventilation on, or different levels of ventilation such as a trickle mode or a boost mode or other defined levels. The selected histogram may be one associated with one or more times or dates or time ranges or date ranges. For example, different histograms may be associated with certain weekdays or weekend days or with office hours or out-of-office hours. It will be appreciated that these are merely examples. Histograms may be associated with multiple criteria, e.g. one histogram may be associated with rising trend and ventilation on. Another histogram may be associated with rising trend and ventilation off. Many such combinations are possible. The purpose of the histograms is to provide more reliable and consistent data on the ventilation rate expected in a given scenario. Each histogram may contain a range of values of ventilation rate (or time constant, or other ventilation rate parameter that is associated with ventilation rate) and the frequency of occurrence of that value based on data accumulated over time. In step S116 a stored ventilation rate is acquired from the selected histogram based on the estimated time constant. The estimated time constant is used as a rough guide to what the ventilation rate is most likely to be. The value from the histogram that is closest to the estimated time constant is then used as a more reliable ventilation rate. This is because the estimation process based on the curve fitting can be fairly approximate and may not be good enough on its own to reliably calculate the number of people in the room. However, it may be good enough to select the correct ventilation rate from a number of candidates. Even when a histogram has been selected based on various parameters such as trend, ventilation state and date/time, there may still be a number of possible ventilation rates for the room 2. This can be due to variable factors such as whether windows and/or doors are open and to what extent they are open. For example an open window to the outside 4 can significantly increase the air exchange rate in a room 2. An open door to another room or corridor may have a similar, although lesser effect. Each scenario (e.g. window open fully, window ajar, door open, door and window open, etc.) can result in a different, but fairly consistent ventilation rate. This will appear as a local peak in the histogram as there will be a higher frequency of occurrence for such ventilation rates. Thus, any given histogram can have several peaks and the estimated time constant can be used to select the most suitable value from among those peaks. As the histogram data may include some noise, filtering of the histogram data may take place before the peak (and thus the ventilation rate) is selected in step S116.

Once the ventilation rate has been selected in step S116, the model function is updated in step S117 to provide a more accurate model of the $CO_2$ (or other contaminant) level in the room 2. In step S118 the updated model function is projected forwards in time to obtain a steady state value representative of the eventual balanced state between supply and extraction, similar to step S83 or S95. Finally, in step S119 the occupancy of the room 2 is estimated using the steady state value and the ventilation rate from the histogram.

It will be appreciated that, although not shown in FIG. 11, the estimated time constant obtained in step S114 can be used to provide a new data point for the histogram. Therefore the histogram can be updated with the new measurement. This may be done either before or after the stored value has been extracted from the histogram in step S116. Thus, over time the histogram (or histograms if more than one is used) can be built up and will become more reliable.

In other examples, and especially where data for a particular room is not available, a default histogram or a customised histogram may be provided based on typical or expected data for the room. This may be based on various factors such as room size, ventilation equipment, number and size of openable vents or windows, number and size of openable doors (and whether they are internal or external doors), etc.

Figure 12:
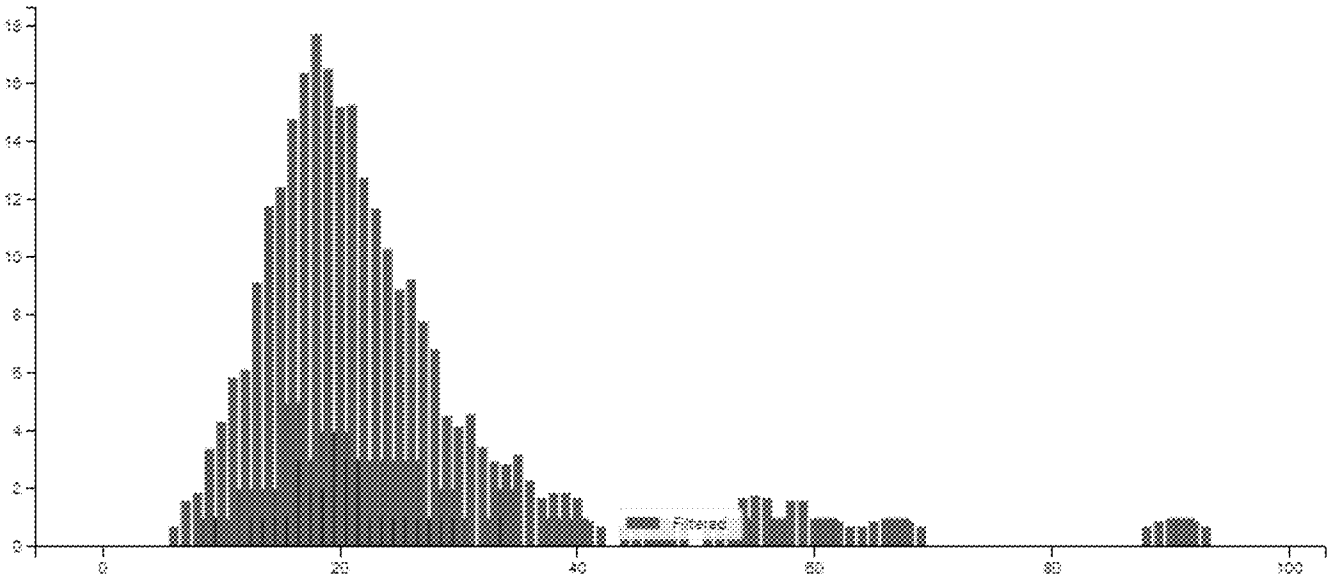
FIG. 12 shows a histogram of time constant values built up over time for one particular room.

FIG. 12 shows an example of a histogram. The vertical axis shows the frequency of occurrence for each time constant bin (in this example, the data is stored as time constants, but in other examples it could be stored as ventilation rates or some other related parameter). The time constant value is shown on the horizontal axis. Each bar in the graph corresponds to a particular time constant bin, i.e. a particular range of time constants. The height of the bar represents the frequency of occurrence of values falling within that corresponding range. Two sets of data are shown on the graph. One set is unfiltered, i.e. raw data. The other set is filtered data which smoothes the raw data using a Gaussian filter and removes some of the noise from the raw data, making it easier to select a local peak. In the filtered data, five local peaks can be identified. The main peak is around a value of 18, with secondary peaks appearing at around 47, 55, 58 and 92. The histogram shown in FIG. 12 is a single histogram for rising trends in a room 2, i.e. in this example there aren't separate histograms for different ventilation states or different days of the week, etc. The main peak at around 18 corresponds to low time constants that are due to the ventilation being fully operational. The significant spread around this value is due to variations in other ventilation influencers, e.g. windows and doors. The vast majority of meetings take place during office hours when the ventilation is on and so this is where most of the data has accumulated. The other local peaks at higher time constants likely correspond to meetings where the building ventilation was not active. The different peaks may correspond to different secondary ventilation influencers. For example these may correspond to an out-of-hours meeting with the mechanical ventilation off, a weekend meeting in good weather with the window open to provide ventilation and an out-of-hours cleaning session with the door propped open. It will be appreciated that these are merely examples and that many different scenarios are possible. Over time, common scenarios will acquire more data and will result in peaks in the histogram that can then be selected based on measured data.

Figure 13:
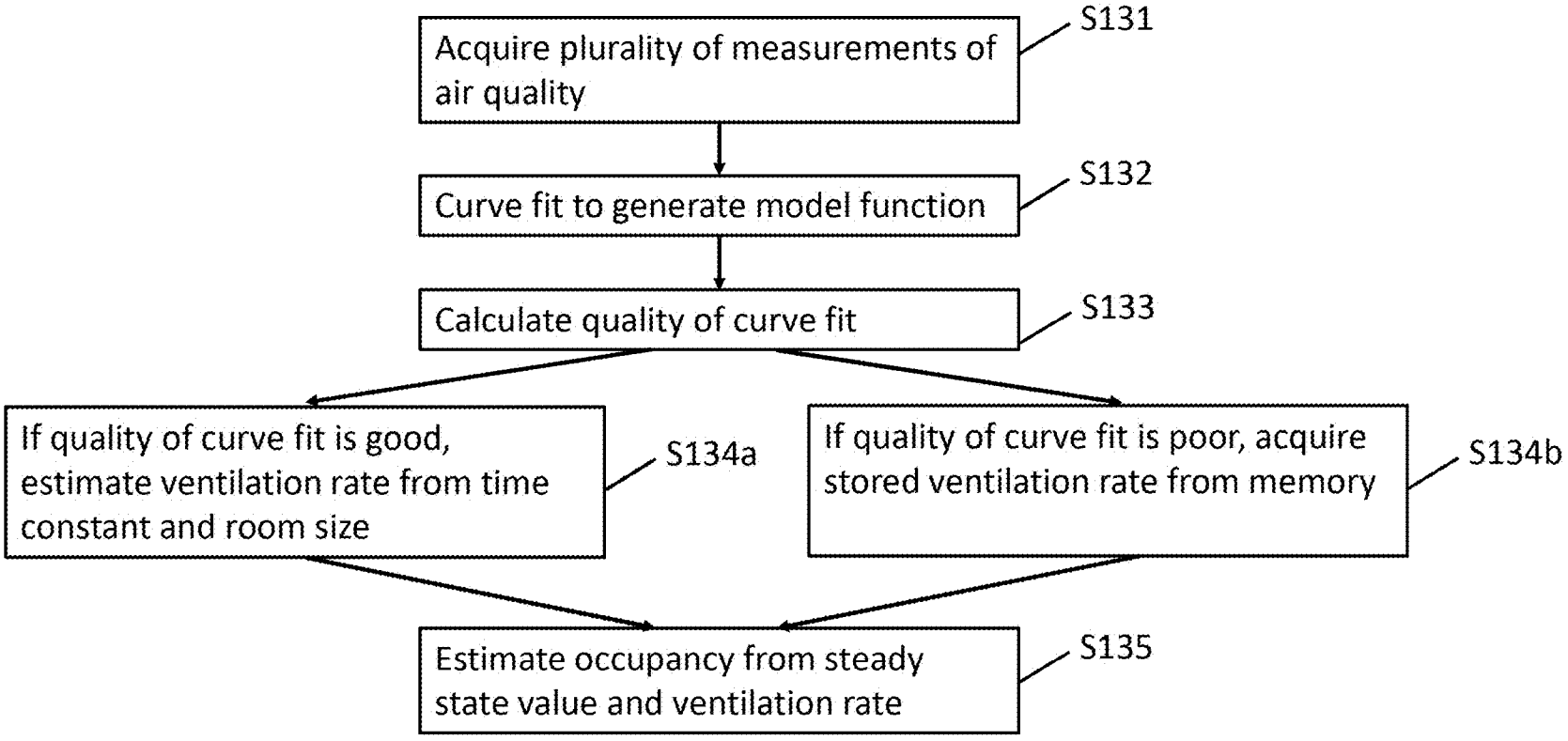
FIG. 13 shows an example of a method of estimating occupancy where the ventilation rate may be obtained from a curve fit or from a stored value.

FIG. 13 shows an example embodiment of a method of estimating occupancy in a room 2 where the ventilation rate may be obtained either from the curve fit or from a value stored in memory. In step S131 a plurality of measurements of air quality are acquired, the same as in previous examples. In step S132 a curve fitting procedure is used on the acquired measurements to generate a model function that fits the measurements. In step S133 a quality of the curve fit is calculated. This may be any suitable measure of quality that indicates whether the model function is an accurate fit to the data (and thus an accurate predictor of future values) or whether the model function is only a rough approximation to the data. For example a sum of least squares residuals may be used as an indicator of the quality of the curve fit. The calculated quality of curve fit is then used to determine whether to proceed via step **S134*a* or step S134*b*. This determination may be a simple comparison against a threshold or other techniques may be used. If the quality of curve fit is determined to be good then the method proceeds to step S134*a* and the ventilation rate is calculated by estimating the time constant of the model function and using the room size to calculate a ventilation rate. This calculation is based on the actual measurements of the room just acquired (which the model fits well) and so may be deemed to be the most accurate predictor of steady state value. Alternatively, if the quality of curve fit is determined to be poor then the method proceeds to step S134*b* and a stored ventilation rate is obtained from memory. In this case the time constant estimated from the poor curve fit is deemed unreliable such that the stored value obtained from memory is likely to be more accurate. The method then proceeds from either step S134*a* or step S134*b* to step S135 in which the occupancy of the room 2 is estimated using the steady state value of the model function (whether based on the raw data or updated based on stored data) and the determined ventilation rate. It will be appreciated that the procedures for steps 134*a* and 134*b* may be varied and may be those discussed above in relation to any of FIGS. 7 to 11**.

Figure 14:
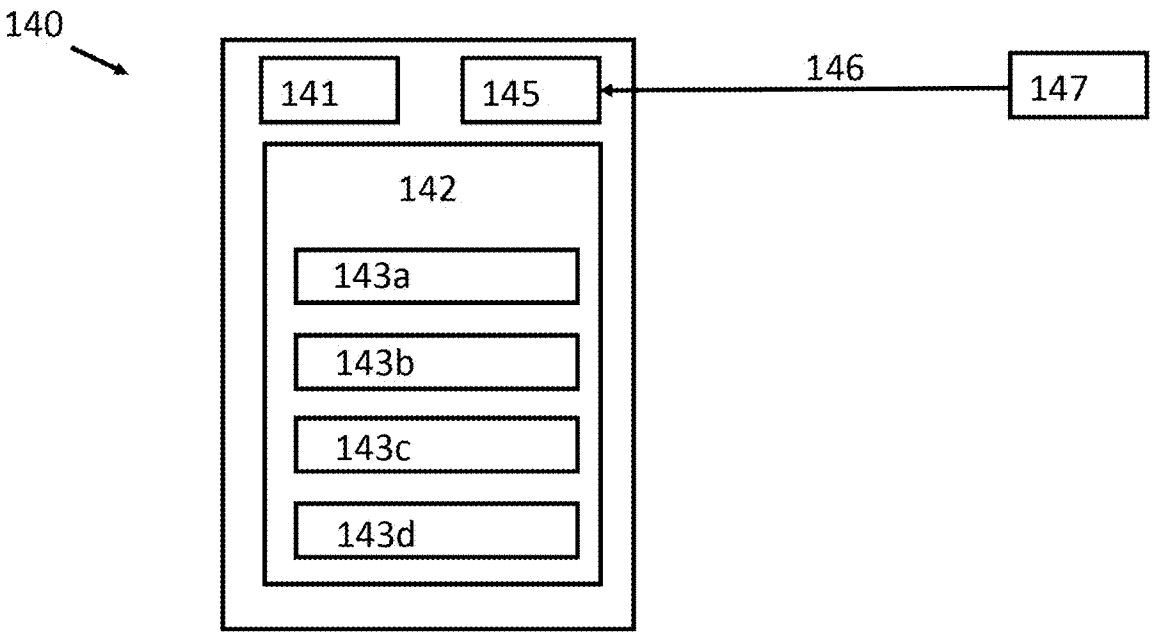
FIG. 14 shows an example computer system that may be used to carry out the methods shown and described.

FIG. 14 shows an example of a computer system 140 with a processor 141 capable of carrying out instructions to execute the various methods discussed above. Computer system 140 includes an input device 145 capable of receiving data 146 from a sensor 147 (e.g. a $CO_2$ sensor, a humidity sensor, a VOC sensor, other sensors or a combination of these). Computer system 140 also includes a memory 142 (which may be a volatile or non-volatile memory or both, e.g. RAM, ROM, Flash memory, magnetic disk, or a combination of these). Stored in the memory 142 are various look up tables or histograms **143*a-d*. The example shown has four histograms which may correspond to a histogram for a rising trend with mechanical ventilation on 143*a*, a rising trend with mechanical ventilation off 143*b*, a falling trend with mechanical ventilation on 143*c* and a falling trend with mechanical ventilation off 143*d***.

Referring back to FIG. 6, in examples which use multiple histograms to provide the desired ventilation rate (or time constant), the regions 64, 65 and 66 are all rising exponentials occurring while the ventilation is on and so would use histogram **143*a* of FIG. 14. Regions 67 and 68 are falling exponentials with the mechanical ventilation on and so would use histogram 143*c* of FIG. 14 and region 69 is a falling exponential with the mechanical ventilation off and so would use histogram 143*d* of FIG. 14**.

It will be appreciated that many variations of the above embodiments may be made without departing from the scope of the invention which is defined by the appended claims.

The invention claimed is:

1. A method of estimating occupancy of a room, comprising:

acquiring a plurality of measurements of an aspect of air quality in the room; and estimating the occupancy of the room based on the plurality of measurements and a room ventilation rate parameter;

wherein estimating the occupancy of the room comprises:

generating a model function by performing a curve fit on the plurality of measurements; and projecting the model function to obtain a projected steady state value of the aspect of air quality.

2. A method as claimed in claim 1, wherein estimating the occupancy comprises estimating a number of people in the room.

3. A method as claimed in claim 1, wherein the aspect of air quality is an aspect that changes dependent on the presence of people.

4. A method as claimed in claim 1, wherein the aspect of air quality is one or more of: $CO_2$ concentration, VOC concentration and humidity level.

5. A method as claimed in claim 1, wherein estimating the occupancy of the room is based on the projected steady state value.

6. A method as claimed in claim 1, wherein the model function is an exponential function; and wherein generating the model function comprises estimating a time constant of the exponential function from the plurality of measurements.

7. A method as claimed in claim 6, further comprising:

calculating an estimated ventilation rate from the estimated time constant.

8. A method as claimed in claim 7, wherein calculating the estimated ventilation rate comprises calculating the estimated ventilation rate from the estimated time constant and a size of the room.

9. A method as claimed in claim 7, wherein the estimated ventilation rate is used as the room ventilation rate parameter.

10. A method as claimed in claim 1, further comprising:

acquiring a stored room ventilation rate parameter from a memory.

11. A method as claimed in claim 10, wherein the memory comprises a lookup table of stored room ventilation rate parameters and wherein acquiring a stored room ventilation rate parameter comprises selecting said parameter from the lookup table based on at least one of: a trend direction of the plurality of measurements, a ventilation operating mode, an estimated ventilation rate, a current time, a current date and/or a current day of the week.

12. A method as claimed in claim 11, wherein the memory comprises at least one histogram of room ventilation rate parameters acquired from previous events in the room; and wherein acquiring the room ventilation rate parameter from the memory comprises selecting a room ventilation rate parameter from one of the at least one histograms.

13. A method as claimed in claim 12, wherein the memory comprises at least one histogram for rising measurements of air quality and at least one histogram for falling measurements of air quality, and wherein the method comprises selecting a histogram for rising measurements of air quality when the plurality of measurements are rising and selecting a histogram for falling measurements of air quality when the plurality of measurements are falling.

14. A method as claimed in claim 12, wherein the memory comprises different histograms for different operating states of mechanical ventilation, and wherein the method comprises selecting a histogram according to a determination of the current state of mechanical ventilation.

15. A method as claimed in claim 12, wherein each histogram of room ventilation rate parameters comprises:

a plurality of parameter bins, each associated with a range of ventilation rate parameters; and for each parameter bin, a value indicating frequency of occurrence of ventilation rate parameters within the associated range.

16. A method as claimed in claim 15, wherein selecting the room ventilation rate parameter from the histogram comprises selecting a parameter bin having a peak frequency of occurrence value and selecting a parameter value representative of the selected parameter bin.

17. A method as claimed in claim 16, wherein selecting the parameter bin having a peak frequency of occurrence value comprises selecting a parameter bin having a local peak frequency of occurrence value closest to an estimated ventilation rate parameter.

18. A method as claimed in claim 17, wherein the model function is an exponential function; and wherein generating the model function comprises estimating a time constant of the exponential function from the plurality of measurements; and wherein the estimated ventilation rate parameter is the estimated time constant.

19. A method as claimed in claim 17, wherein the model function is an exponential function;

wherein generating the model function comprises estimating a time constant of the exponential function from the plurality of measurements;

the method further comprising:

calculating an estimated ventilation rate from the estimated time constant; and wherein the estimated ventilation rate parameter is the estimated ventilation rate.

20. A method as claimed in claim 19, wherein calculating the estimated ventilation rate comprises calculating the estimated ventilation rate from the estimated time constant and a size of the room.

21. A method as claimed in any of claim 16, wherein finding the peak frequency of occurrence value comprises filtering the frequency of occurrence values to smooth the data and then finding a peak in the filtered data.

22. A method as claimed in claim 10, wherein the method comprises steps of:

curve fitting the plurality of measurements to generate a model function;

calculating a quality of the curve fit; and based on the calculated quality of the curve fit, determining whether to i) calculate a room ventilation rate parameter from the model function or ii) acquire a room ventilation rate parameter from the memory.

23. A system for estimating occupancy of a room, comprising:

a processor; and a memory;

wherein the memory comprises instructions which when executed by the processor cause the processor to:

acquire a plurality of measurements of an aspect of air quality in the room; and estimate the occupancy of the room based on the plurality of measurements and a room ventilation rate parameter;

wherein estimating the occupancy of the room comprises:

generating a model function by performing a curve fit on the plurality of measurements; and projecting the model function to obtain a projected steady state value of the aspect of air quality.

24. A computer-readable medium, which is non-transitory, comprising instructions which when executed on a computer, cause the computer to:

acquire a plurality of measurements of an aspect of air quality in the room; and estimate the occupancy of the room based on the plurality of measurements and a room ventilation rate parameter;

wherein estimating the occupancy of the room comprises:

generating a model function by performing a curve fit on the plurality of measurements; and projecting the model function to obtain a projected steady state value of the aspect of air quality.

* * * * *